US006650820B2

(12) United States Patent
Ross et al.

(10) Patent No.: US 6,650,820 B2
(45) Date of Patent: Nov. 18, 2003

(54) OPTICAL FIBER WINDING TOOL

(75) Inventors: Olivier Ross, Beaconsfield (CA); Jean-François Moquin, Laval-des-Rapides (CA); Stéphane Joubert, Mirabel (CA); Pierre Martineau, Deux-Montagnes (CA); Christian Dufour, Montreal (CA)

(73) Assignee: ITF Optical Technologies Inc., Ville St-Laurent (CA)

( * ) Notice: Subject to any disclaimer, the term of this patent is extended or adjusted under 35 U.S.C. 154(b) by 196 days.

(21) Appl. No.: 10/002,720

(22) Filed: Dec. 5, 2001

(65) Prior Publication Data

US 2003/0103751 A1 Jun. 5, 2003

(51) Int. Cl.[7] ..... G02B 6/00; B65H 54/18
(52) U.S. Cl. ..... 385/134; 242/484.6
(58) Field of Search ..... 385/134, 137; 242/362, 571.6, 529, 535, 548, 484.6

(56) References Cited

U.S. PATENT DOCUMENTS 4,138,069 A * 2/1979 Bonzo et al. ..... 242/474.5
4,160,360 A * 7/1979 Carvalho et al. ..... 57/81
5,110,061 A * 5/1992 Berry ..... 242/484.6
6,056,032 A * 5/2000 Vohra et al. ..... 156/425
6,553,205 B1 * 4/2003 Liu ..... 399/348

* cited by examiner

*Primary Examiner*—Chandrika Prasad
(74) *Attorney, Agent, or Firm*—Louis Tessier

(57) ABSTRACT

An optical fiber winding tool for winding a strip of optical fiber. The optical fiber winding tool having a guiding body defining a guiding recess. A fiber inlet aperture extends into the guiding recess for allowing the slideable insertion of the strip of optical fiber thereinto. The recess peripheral wall is configured and sized such that as the strip of optical fiber is inserted through the fiber inlet aperture, a recess peripheral surface abuttingly guides the optical fiber strip into a generally parabolic configuration that sweeps against the recess peripheral surface while the optical fiber winds into a coil. The optical fiber winding tool is mountable over a flat surface with the peripheral edge of the guiding recess abuttingly contacting the supporting surface. A driving assembly is optionally provided for driving the strip of fiber into the guiding recess.

20 Claims, 6 Drawing Sheets

OPTICAL FIBER WINDING TOOL

FIELD OF THE INVENTION

The present invention relates to the general field of optical fiber accessories and is particularly concerned with an optical fiber winding tool.

BACKGROUND OF THE INVENTION

The use of optical fibers for telecommunication systems and other applications has become increasingly prevalent over the past few years. As is well known in the art, optical fibers are typically hair thin structures, capable of transmitting light signals at high rates and with low signal loss. They are ideally suited to the high requirements of digital transmission and, hence, are well matched to the evolving worldwide transmission network.

The most popular medium for light wave transmission through optical fibers is glass, a solid whose structure is amorphous. Commercial optical fibers are drawn from a pre-form, an elongated cylinder of glass having an inner core and an outer cladding, with the thickness of the core and the cladding typically being in the same ratio in the fiber as they are in the pre-form. During the drawing process, the pre-form is fed into a heated region where it necks down to the fiber size as the fiber is pulled from the heat zone. A coating is applied to the freshly drawn fiber before it touches any capstans or rollers. The coating protects the fiber from the environment and cushions it from external forces that induce micro-bending losses. The drawn fiber is taken up on spools in such a manner that the end portions of the fiber on each spool are available for testing. The spools of drawn, tested fibers are subsequently used to supply ribbon and cabling processes and apparatus.

The winding parameters during take up must be carefully controlled. Collection of the fiber at low tension is necessary in order to minimize damage to the fiber or coating thereon and to reduce the effect of micro-bending and macro-bending losses on the transmission media. The winding tension is minimized and the distribution of fiber across a spool is controlled to provide a desired package profile and to facilitate unwinding at a subsequent operation. Hence, great care is usually taken in order to minimize potential damages to the fiber during the initial winding step following the drawing of the fiber. Unfortunately, such concern with the possible damages resulting from improper handling of optical fibers, particularly during the critical winding steps, is often neglected once the fiber leaves the fiber-manufacturing site.

The specific handling requirements of optical fibers are directly linked to their inherent structure. Indeed, optical fibers being made of glass are characterized by their brittleness. A typical glass fiber will stretch elastically to about 7% strain and break abruptly without undergoing any permanent deformation. The actual breaking strengths between fibers will vary widely and depend on a variety of factors. The reason for this wide range is attributed to submicroscopic cracks in the fiber surface. These cracks can be inherent to the glass itself or a result of manufacturing processes and handling of the fiber.

The mere manipulation of the fiber, even by a skilled worker, may potentially lead to reduce mechanical and/or optical properties. Indeed, localized pressure on the fiber tends to deform the core, which is a softer glass than the cladding, causing radiated losses and mode coupling also referred to as micro-bending losses. Micro-bends consist of microscopic random deviations of a fiber around its straight nominal position. The amplitude of the deviation is typically a few microns or less and their period less than a millimeter. In multi-mode fibers, micro-bends cause light to be exchanged among the various guided modes, some of which have higher losses than others. In both multi-mode and single mode fibers, light can couple into modes that escape from the core. The small deflections usually result from fiber coating, cabling, packaging or other localized forces. They can also be created during the manual handling of the fiber by squeezing the fiber between the fingers of the intended user. Although micro-bending losses typically return to zero when the localized forces are removed, they may potentially create permanent losses.

Fibers exposed to active environments and under stress, weaken with time because existing cracks grow. Termed static fatigue, this crack-growth phenomenon limits the residual stress that a fiber can sustain over a period of time and imposes a minimum bend radius on fibers. Indeed, bending a fiber produces tensile stresses along its outer portion and compressive stresses along its inner portion. The minimum bend radius depends on various factors including specifications in given applications. For most applications, a 1" minimum bend radius is usually recommended as being a comfortable minimum bend radius for an installed fiber, both to minimize bending induced loss and also to preserve fiber lifetime. A minimum bend radius also needs to be respected during winding operations. This tends to be difficult, especially with relatively short strips of optical fibers.

Hence, aside from breakage, optical fiber communication performance may be degraded by micro-cracks or micro-bends in the fiber generated by bending or other stresses imposed on the fiber. Such damage to an optical fiber not only reduces the fibers long-term durability, but it also causes losses in optical signal strength and content. As mentioned previously, great care is usually taken during initial handling and winding of the fibers at the manufacturing site. In order to reduce the risks of physically damaging the fiber, the control of fiber tension during initial winding immediately after the drawing of the fiber requires relatively sophisticated equipment.

In order to control fiber tension in the freshly drawn fiber, the latter is typically allowed to form a catenary between the capstan and the take up. As the spool fills, the catenary tends to decrease in length and it becomes necessary to decrease take up motor speed under controlled conditions. This is typically accomplished with an electro-optical system including a closed circuit television camera, which detects any change in the height of the fiber catenary and causes changes in the take up motor speed. Once initially wound, the fiber is shipped on a spool to other companies or clients that either use the fiber or further process the latter.

There exists a plurality of situations wherein an optical fiber needs to be re-wound into a coil after the initial winding on a spool at the manufacturing site. Some applications, such as the manufacturing of optic sensing devices, inherently require winding of the fiber. Other situations are related to general handling of the fiber. For example, it may be desirable to mount optical devices, such as multiplexers, demultiplexers, switches or the like, on relatively short strips of fibers, commonly referred to as "pigtails" that are eventually spliced to longer segments of optical fiber. The mounting of such optical components on strips of optical fiber requires handling and temporary storage of the fiber segments. The use of relatively sophisticated equipment and method conventionally used for initially winding the drawn fiber as herein above disclosed is not well suited to this type of application.

In assembly lines wherein optical components are attached to strips of optical fiber, the latter is wound at various stations. For example, once the optical component is attached to a pigtail, the pigtail is typically manually wound into a coil prior to shipment to an intended customer. The manual winding of pigtails presents numerous drawbacks. The operation is both tedious and time consuming. Furthermore, it involves repetitive and relatively unergonomical movements that may potentially lead to work related injuries such as tendonitis or the like.

Furthermore, as mentioned previously, manual winding of the pigtails may potentially lead to damages in the fiber with resulting loss of efficiency and reduced longevity. Accordingly, there exists a need for an optical fiber winding device.

Advantages of the present invention include that the proposed optical fiber winding tool allows for the winding of a strip of optical fiber into a generally toroidal-shaped coil with low residual strain. Also, the proposed optical fiber winding tool reduces the risks of inducing mechanical stresses to the fiber during the winding operation, thereby reducing the risk of mechanically damaging the fiber and/or reducing its optical performance by micro-bending losses or other phenomena. Furthermore, the proposed optical fiber winding tool allows for winding strips of optical fiber while preserving a predetermined minimum bend radius throughout the winding process.

Still further, the proposed optical fiber winding tool allows for the winding of strips of optical fiber having optical or mechanical components attached thereto. The proposed optical fiber winding tool also allows for the winding of cables having a wide range of mechanical properties. Furthermore, the proposed optical fiber winding tool allows for the winding of both relatively short and relatively long strips of optical fibers in various contexts.

Still further, the proposed optical fiber winding tool allows for the winding of strips of optical fiber through a set of relatively easy and ergonomic steps, thus reducing both mental and physical fatigue. Furthermore, the proposed optical fiber winding tool allows for the winding of optical cables without requiring special tooling or manual dexterity. The proposed optical fiber winding tool is designed so as to be compact and easily carried with minimal effort to diverse locations so that it can be used in various settings with reduced risks of damaging the optical fiber winding tool or strips of fiber inserted therein.

Furthermore, the proposed optical fiber winding tool is designed so as to be manufacturable using conventional forms of manufacturing and conventional materials so as to provide an optical fiber winding tool that will be economically feasible, long lasting and relatively trouble free in operation. The proposed optical fiber winding tool is designed so as to be relatively mechanically simple so as to provide a durable winding tool requiring relatively low maintenance.

Optionally, the proposed optical fiber winding tool only requires the installation of a segment of a strip of optical fiber within the tool, the winding operation being performed automatically without requiring manual intervention. Furthermore, the proposed optical fiber winding tool optionally allows for the simultaneous winding of more than one strip of optical fiber into a single coil.

In accordance with an embodiment of the invention, there is provided an optical fiber winding tool for winding a strip of optical fiber into a coil, the optical fiber winding tool being mountable on a generally flat supporting surface and allowing manual winding of the strip of optical fiber by the hands of an intended user, the strip of optical fiber defining a strip first longitudinal end, an opposed strip second longitudinal end and a strip intermediate section extending therebetween, the optical fiber winding tool comprising:a guiding body having a body outer surface and defining a guiding recess, the guiding recess defining a recess peripheral edge delimiting a recess aperture leading into the guiding recess, the recess aperture being in an aperture geometrical plane; a recess peripheral wall having a recess peripheral surface that extends inwardly into the guiding body from the recess peripheral edge, the recess peripheral surface delimiting the boundary of the guiding recess; a fiber inlet aperture formed in the guiding body and leading into the guiding recess, the fiber inlet aperture being sized for allowing the slidable insertion of the strip of optical fiber into the guiding recess; the recess is peripheral wall being configured and sized such that when the recess aperture is mounted over the supporting surface and the strip of optical fiber is inserted through the fiber inlet aperture, the strip first longitudinal end contacts the supporting surface and the recess peripheral surface abuttingly guides the strip intermediate section so that further insertion of the strip of optical fiber into the guiding recess causes the strip of optical fiber to wind into a coil against the recess peripheral surface adjacent the supporting surface.

Preferably, the guiding recess is configured and sized such that the strip of optical fiber maintains a predetermined minimal bend radius as it abuttingly contacts the recess peripheral surface during the winding of the strip of optical fiber into a coil. Conveniently, the recess peripheral surface has a generally frustro-conical configuration defining a recess apex region. Also, conveniently, the fiber inlet aperture is positioned adjacent the recess apex region.

Preferably, the guiding body also defines an alignment section having a guiding channel that extends from the body outer surface to the fiber inlet aperture, the guiding channel being configured and sized so that the strip of optical fiber maintains a predetermined minimal bend radius as it slides therethrough. Typically, the guiding body includes a removable body segment allowing selective lateral access to the interior of the guiding recess.

Conveniently, the optical fiber winding tool further comprises a fiber outlet slot formed in the guiding body for allowing an outlet segment of the optical fiber segment to extend out of the guiding recess in a direction substantially parallel to the aperture geometrical plane and tangential relative to the coil.

Preferably, the optical fiber winding tool further comprises a hand guiding means attached to the guiding body for guiding the hands of the intended user as the intended user drives the strip of optical fiber into the guiding recess. Conveniently, the optical fiber winding also further comprises a multiple fiber separating means mounted on the guiding body for physically separating and guiding at least two individual optical fiber strips when the at least two individual optical fiber strips are inserted simultaneously into the guiding recess through the inlet aperture.

Preferably, the fiber separating means includes a separating block mounted on the guiding body, the separating block having at least two separating slots formed therein for individually receiving one of the at least two individual optical fiber strips.

Preferably, the optical fiber winding tool further comprises a driving means attached to the guiding body for driving the strip of optical fiber into the guiding recess through the fiber inlet aperture. Typically, the driving means includes a fluid guiding means for guiding the flow of a pressurized fluid in such a manner that the pressurized fluid is in contact with the strip of optical fiber and drives the strip of optical fiber through the fiber inlet aperture and into the guiding recess.

Preferably, the driving means includes a driving head attached to the guiding body, the driving head defining a driving head external surface and having a main fluid channel extending therethrough, the main fluid channel defining a main channel longitudinal axis, the main fluid channel being configured and sized for slidably receiving the strip of optical fiber and for allowing through flow of the pressurized fluid therealong, the driving head also including a fluid connecting means for allowing the main fluid channel to be connected to a source of pressurized fluid.

Conveniently, the driving head is provided with a head panel, the head panel being movable between a panel open configuration and a panel closed configuration, wherein when the head panel is in the panel open configuration the head panel allows access to the main fluid channel from a direction oriented at an angle relative to the main channel longitudinal axis and when the head panel is in the closed configuration the head panel prevents access to the main fluid channel from a direction at an angle relative to the main channel longitudinal axis.

Preferably, the driving means includes an auxiliary channel extending from the driving head external surface to the main fluid channel at angle relative thereto, the auxiliary channel being in fluid communication with the main fluid channel; the auxiliary channel being provided with a fluid coupling means for coupling the auxiliary channel to a source of pressurized gas.

BRIEF DESCRIPTION OF THE DRAWINGS

An embodiment of the present invention will now be disclosed, by way of example, in reference to the following drawings, in which.

DETAILED DESCRIPTION

Figure 3:
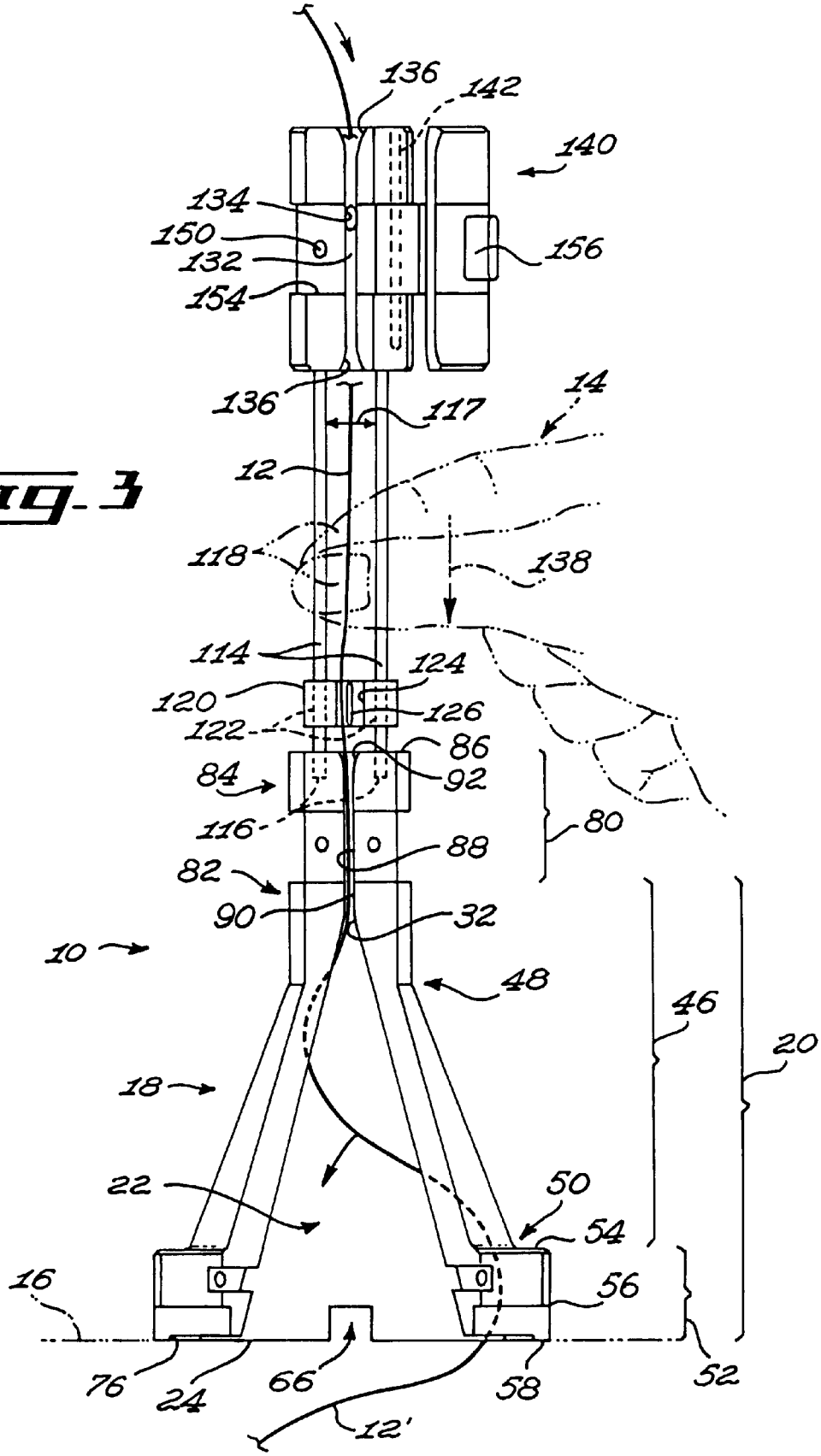
FIG. 3: in a front elevational view, illustrates the optical fiber winding tool shown in FIGS. 1 and 2 in an open configuration and with a strip of fiber being manually wound therewith.

Referring to FIG. 3, there is shown an optical fiber winding tool (10) in accordance with an embodiment of the present invention. The optical fiber winding tool (10) is shown in an opened configuration in order to allow visualization of a strip of optical fiber (12) being wound therewith. The strip of optical fiber (12) is shown being wound with the help of the optical fiber winding tool (10) by the hand (14) of an intended user. The optical fiber winding tool (10) is shown mounted on a generally flat supporting surface (16).

The optical fiber winding tool (10) includes a guiding body (18) having a body outer surface (20) and defining a guiding recess (22). As shown more specifically in FIG. 5, the guiding recess (22) defines a recess peripheral edge (24) delimiting a recess aperture (26) leading into the guiding recess (22). The recess aperture (26) and its recess peripheral edge (24) both extend in a generally flat aperture geometrical plane.

The guiding recess (22) also defines a recess peripheral wall having a recess peripheral surface (30). The recess peripheral surface (30) extends inwardly into the guiding body (18) from the recess peripheral edge (24). The recess peripheral surface (30) delimits the boundary of the guiding recess (22). The recess peripheral surface (30) preferably has a generally smooth texture.

The optical fiber winding tool (10) also includes a fiber inlet aperture (32) formed in the guiding body (18) and leading into the guiding recess (22). The fiber inlet aperture (32) is sized for allowing the slideable insertion of the strip of optical fiber (12) into the guiding recess (22).

Figure 10:
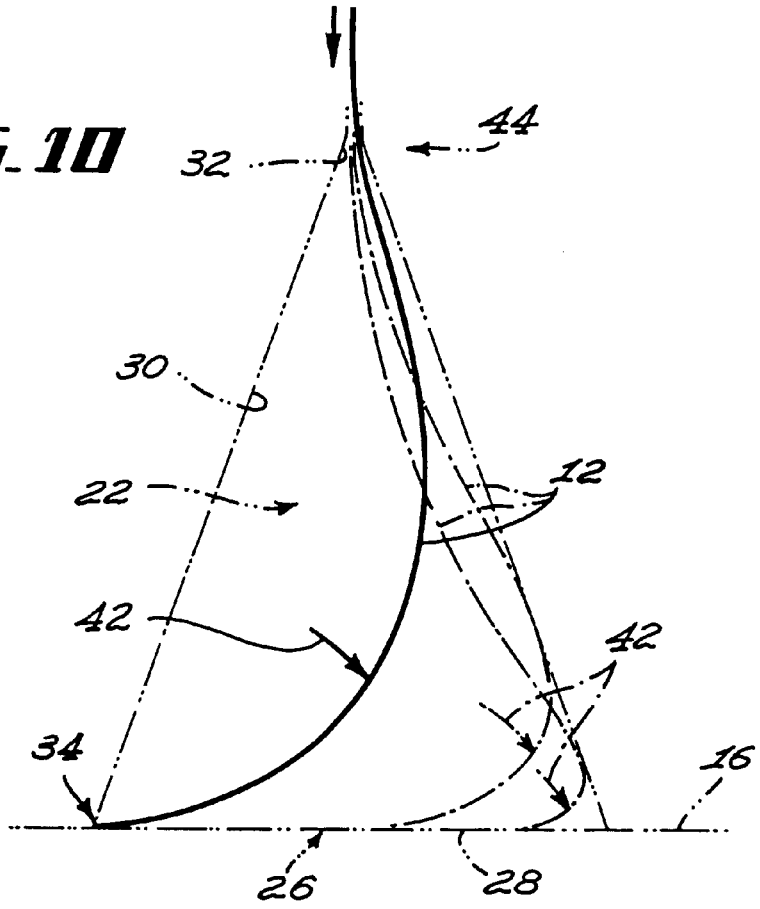
FIG. 10: in a schematic elevational view, illustrates a typical configuration taken by a strip of fiber as it is being wound by the optical fiber winding tool in accordance with an embodiment of the present invention.

As shown schematically in FIG. 10, the guiding recess (22) is configured and sized such that when the guiding recess (22) is mounted over the supporting surface (16) with the supporting surface (16) obstructing the recess aperture (26), the insertion of the strip of optical fiber (12) through the fiber inlet aperture (32) causes a strip first longitudinal end (34) to eventually contact the supporting surface (16). The guiding recess (22) is also configured and sized such that further insertion of the strip of optical fiber (12) through the fiber inlet aperture (32) eventually causes an intermediate section of the strip of optical fiber (12) located between first and second longitudinal ends thereof to contact the recess peripheral surface and allow the latter to guide the optical fiber (12) into a generally toroidal-shaped-like coil such as the coil (38), illustrated in FIG. 11. Insertion of the optical fiber (12) into the fiber inlet aperture (32) is indicated by arrow (40) in FIG. 10.

The configuration and size of the guiding recess (22) allows the segment of optical fiber (12) to abuttingly contact both the supporting surface (16) and the recess peripheral surface (30). The configuration and size of the guiding recess (22) combined with the inherent structural characteristics, such as rigidity and resiliency of the segment of optical fiber (12), causes the latter to eventually bend into a generally parabolic-like configuration as illustrated in full lines in FIG. 10. FIG. 10 also illustrates, schematically, that as the strip of optical fiber (12) is further inserted into the guiding recess (22), the segment of optical fiber (12) winds into the coil (38) against the recess peripheral surface (30) adjacent to the supporting surface (16) while the parabolic segment rotates around the guiding recess (22) abuttingly sweeping against the recess peripheral surface (30). The phantom lines in FIG. 10 illustrate the evolving configuration of the strip of optical fiber (12) sweeping against the recess peripheral surface (30).

The guiding recess (22) is configured and sized such that the strip of optical fiber (12) maintains a predetermined minimal bend radius as it abuttingly contacts and sweeps against the recess peripheral surface (30) during the winding of the strip of optical fiber (12) into the coil (38). In a preferred embodiment of the invention, the recess peripheral surface (30) has a generally frustro-conical configuration defining a recess apex region (44) and causing the strip of optical fiber to assume a generally parabolic-like configuration. The circumferential sweeping movement of the parabolic-like segment of the strip of optical fiber (12) is indicated by arrows (42) in FIG. 10. When the recess peripheral surface (30) has a generally frustro-conical configuration, the fiber inlet aperture (32) is preferably positioned adjacent the recess apex region (44). It should be understood that the recess peripheral surface (30) could assume other configurations and that the fiber inlet aperture (32) could be positioned at other locations without departing from the scope of the present invention.

Referring back to FIG. 3, there is shown that, the body outer surface (20) preferably defines a body main outer surface (46) having a generally frustro-conical configuration. The body main outer surface (46) defines a main outer surface first end (48) adjacent its apex and a main outer surface second end (50), adjacent its base. Preferably, a body base flange (52) extends integrally from the body main outer surface second end (50).

The body base flange (52) typically extends radially outwardly from the body main outer surface (46). Typically, the body base flange (52) has a generally annular configuration defining a base flange spacing surface (54) extending substantially outwardly from the main outer surface second end (50). A base flange peripheral surface (56) and a body abutment surface (58) extending in a generally parallel relationship relative to the base flange spacing surface (54). Typically, the optical fiber winding tool (10) includes a generally frustro-conical wall defining both the frustro-conical recess peripheral surface (30), the body main outer surface (46), the body base flange (52) and the annular body abutment surface (58).

Figure 5:
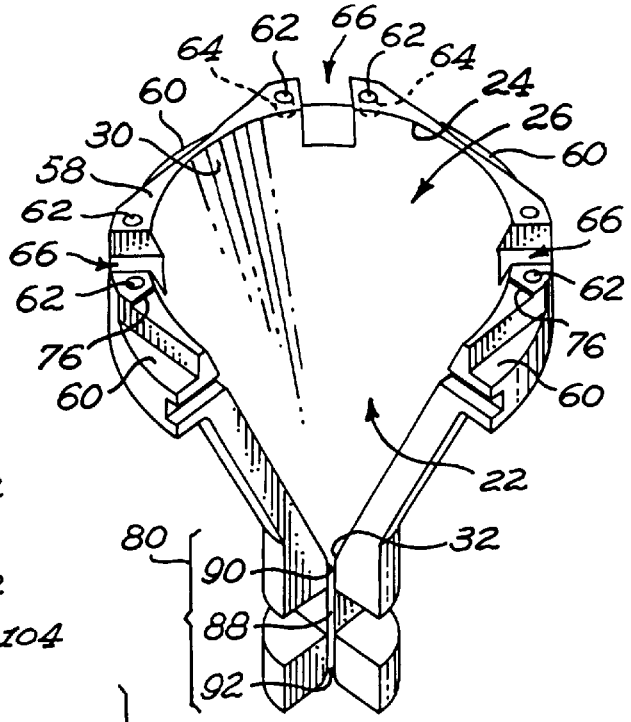
FIG. 5: in an inverted perspective view, illustrates the configuration of the bottom section of the optical fiber winding tool shown in FIG. 4.
Figure 6:
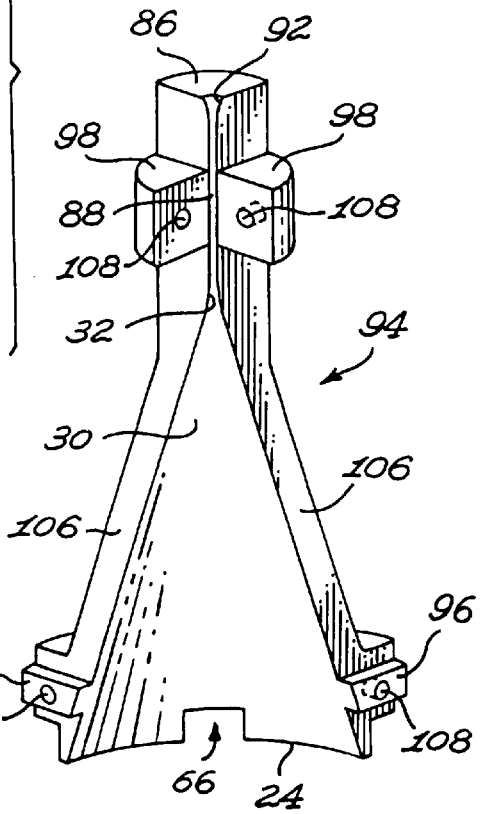
FIG. 6: in a perspective view, illustrates a removable peripheral wall segment part of the optical fiber winding tool in accordance with an embodiment of the present invention.

As illustrated more specifically in FIG. 5, the body abutment surface (58) is preferably provided with peripheral angled recesses (60) for facilitating the manipulation of the guiding body (18) and for reducing the density of the body base flange (52). The body abutment surface (58) is optionally provided with a base flange-to-supporting surface securing means for securing the relative positioning between the guiding body (18) and the supporting surface (16). The base flange-to-supporting surface securing means preferably includes at least one and preferably a set of magnet components (62) inserted in corresponding base magnet apertures (64) formed in the body abutment surface (58). The magnet components (62) are provided for generating a magnetic force adapted to releasably secure the body abutment surface (58) to the supporting surface (16) when the latter is made out of a magnetizable material, such as a metallic alloy or the like.

As illustrated more specifically in FIGS. 4 through 6 and 9, the body abutment surface (58) is preferably further provided with pin receiving recesses (66) formed therein for receiving corresponding mounting pins (68) optionally extending from the supporting surface (16). Each mounting pin (68) typically includes a generally cylindrical pin spacing segment (70) extending substantially perpendicularly from the supporting surface (16) in a generally disc-shaped pin-retaining segment (72) mounted on the pin spacing segment (70) so as to extend in a direction generally parallel to the supporting surface (16). As illustrated more specifically in FIG. 4, four mounting pins (68) typically extend from the supporting surface (16) and are strategically positioned so as to abuttingly retain the wound coil (38) of optical fiber (12). The mounting pins (68) are typically strategically positioned so as to preserve the minimum bend radius and so as not to create undue stress on the strip of optical fiber (12) as the latter urges against the mounting pins (68) as it tends to resiliently spring back to its uncoiled state.

Figure 9:
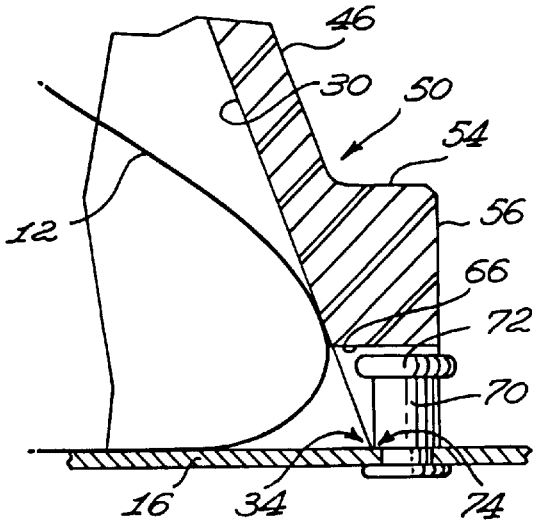
FIG. 9: in a partial cross-sectional view with section sections taken out, illustrates a portion of a base segment, part of the optical fiber winding tool in accordance with an embodiment of the present invention. The section of the base segment being shown mounted on a mounting plate and being used for guiding a segment of a fiber strip.

As illustrated more specifically in FIG. 9, each pin receiving recess (66) is configured and sized so as to substantially fittingly receive a corresponding mounting pin (68). Furthermore, each pin receiving recess (66) is configured, sized and positioned so that the intersection (74) between the supporting surface (16) and both the base of the pin spacing segment (70) and the recess peripheral edge (34) are substantially in register with one another while the pin retaining segment (72) remains outwardly positioned relative to the recess peripheral surface (30).

The intersection (74) is positioned such that when the guiding body (18) is lifted away from the supporting surface (16) for allowing retrieval of the coil (38) of optical fiber (12), the coil (38) of optical fiber (12) remains in abutting contact with a retaining structure having substantially the same diameter as the abutting section of the recess peripheral surface (30). The outward positioning of the pin-retaining segment (72) relative to the recess peripheral surface ensures that the pin-retaining segment (72) does not interfere with sweeping segments of optical fiber (12) being guided by the recess peripheral surface (30), during the winding operation.

Figure 4:
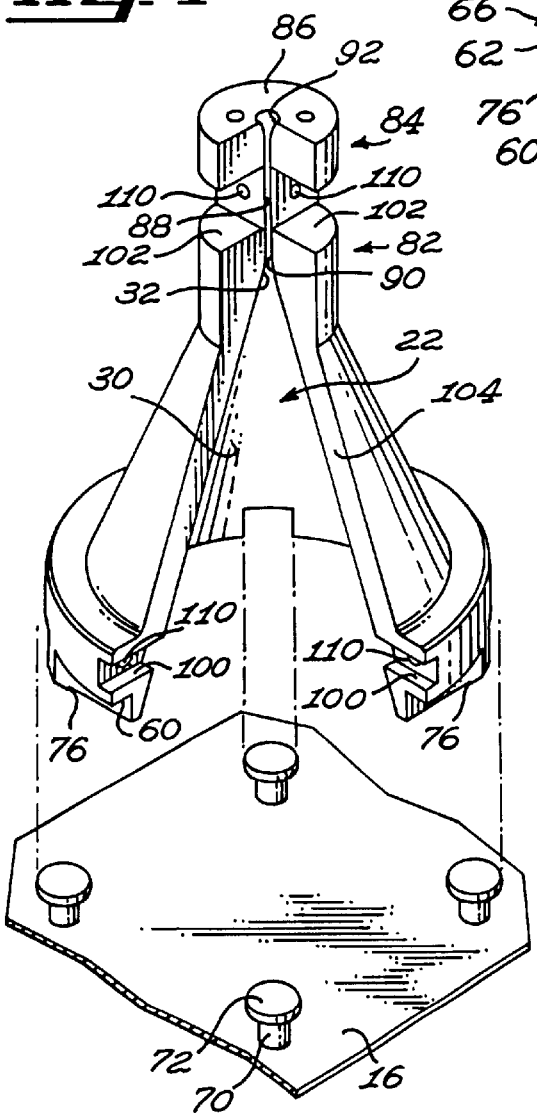
FIG. 4: in a partial perspective view with sections taken out, illustrates the optical fiber winding tool in an open configuration and about to be mounted on a mounting plate.
Figure 11:
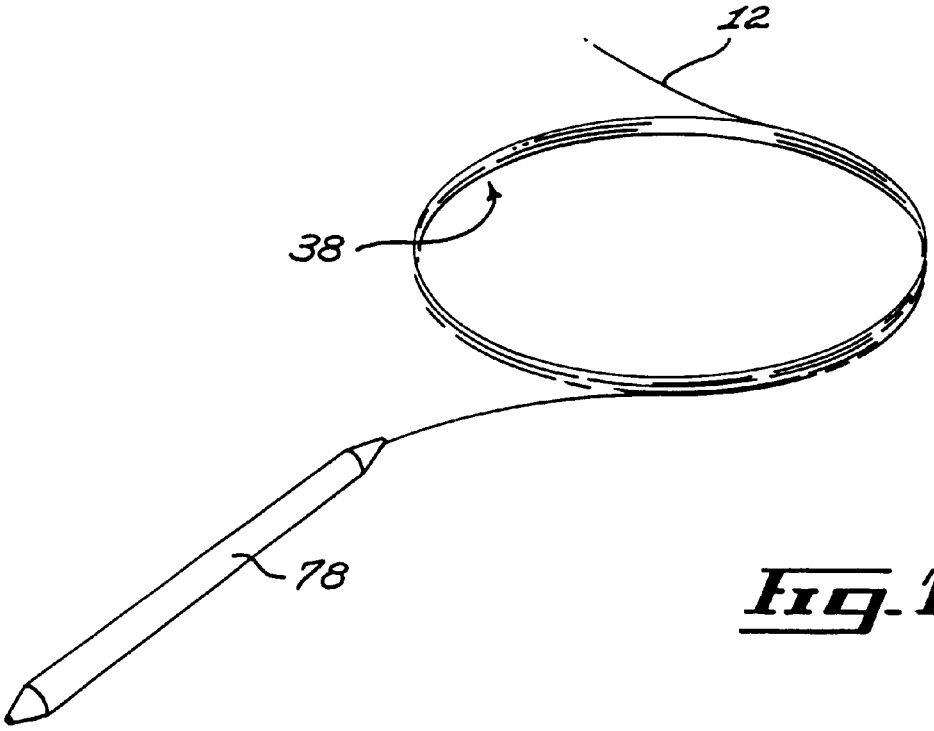
FIG. 11: in a perspective view, illustrates a strip of fiber having been wound by the optical fiber winding tool in accordance with the present invention and having an optical component attached thereto.

As illustrated more specifically in FIGS. 3 through 5, the optical fiber winding tool (10) preferably includes a fiber outlet slot (76) formed in the guiding body (18) for allowing an outlet segment (12') of the strip of optical fiber (12) to extend out of the guiding recess (22) in a direction substantially parallel to the aperture geometrical plane and in a direction substantially tangential relative to the coil (38). Preferably, the outlet slot (76) is formed by a slot recess provided in the body abutment surface (58) cooperating with the supporting surface (16) to allow a single outlet segment (12') to extend out of the guiding recess (22). The fiber outlet slot (76) is particularly useful in situations wherein, for example, an optical component such as the optical component (78) in FIG. 11, is attached to the strip of optical fiber (12) adjacent a strip second longitudinal end (36). In situations of this type, the optical component (78) may be positioned outside of the optical fiber winding tool (12), adjacent the latter, during the winding operation with the outlet segment (12') extending through the fiber outlet slot (76) while the remainder of the strip of optical fiber (12) is being wound by the optical fiber winding tool (10).

The body outer surface (20) typically also includes a generally cylindrical alignment section (80) extending from the main outer surface first end (48). The alignment section (80) has a guiding channel (88) extending there through. The guiding channel (88) is in communication with the fiber inlet aperture (32). The guiding channel (88) is configured and sized so that the strip of optical fiber (12) maintains a predetermined minimal bend radius as it slides there through and into the fiber inlet aperture (32). The alignment section (80) defines an alignment section first longitudinal end (82), preferably merging integrally with the main outer surface first end (48). The alignment section (80) also defines an alignment section second longitudinal end (84). The alignment section second longitudinal end (84), in turn, defines a generally disc-shaped alignment section attachment surface (86).

The alignment section (80) is provided with a guiding channel (88) extending there through from the alignment section attachment surface (86) to the fiber inlet aperture (32). Opposed longitudinal ends of the guiding channel (88) located adjacent corresponding alignment section first and second longitudinal ends (82) and (84) are provided with an outwardly widening generally conical taper (90), (92) for ensuring that the strip of optical fiber (12) maintains a minimal bend radius respectively as it enters the guiding recess (22) through the fiber inlet aperture (32) and as it passes from outside the guiding body (18) to the guiding channel (88).

The guiding body (18) preferably further includes a lateral access means for providing selective lateral access to the interior of the guiding recess (22). Typically, although by no means exclusively, the lateral access means includes a removable body segment (94), illustrated in greater details in FIG. 6. In the preferred embodiment wherein the guiding body includes a generally frustro-conical wall defining both the recess peripheral surface (30) and the body main outer surface (46), the removable body segment (94) typically includes a longitudinal segment of the frustro-conical wall having flange and alignment section tongues (96), (98) extending substantially circumferentially therefrom for insertion into corresponding flange and alignment section grooves (100), (102) formed in circumferential wall surfaces (104) of the remaining guiding body (18).

Typically, the circumferential base and alignment section tongues (98) and the circumferential base and alignment section grooves (100), (102) are provided with cooperating releasable locking means for releasably locking the removable body segment (94) in a closed configuration wherein the recess peripheral surface (30) forms a continuous surface. The removable body segment releasable locking means typically takes the form of tongue and groove magnet components (108), (110).

The removable body segment defines a removable body segment circumferential wall (106) at the junction with the remainder of the guiding body (18). The removable body segment circumferential wall (106) is adapted to contact the circumferential wall surface (104) of the remainder of the guiding body (18) when the removable body segment (94) is in its closed configuration. The removable body segment (94) is adapted to allow lateral access to the interior of the guiding recess (22) in order to facilitate installation of the strip of optical fiber (12) prior to its winding as will be hereinafter disclosed in greater details.

Figure 1:
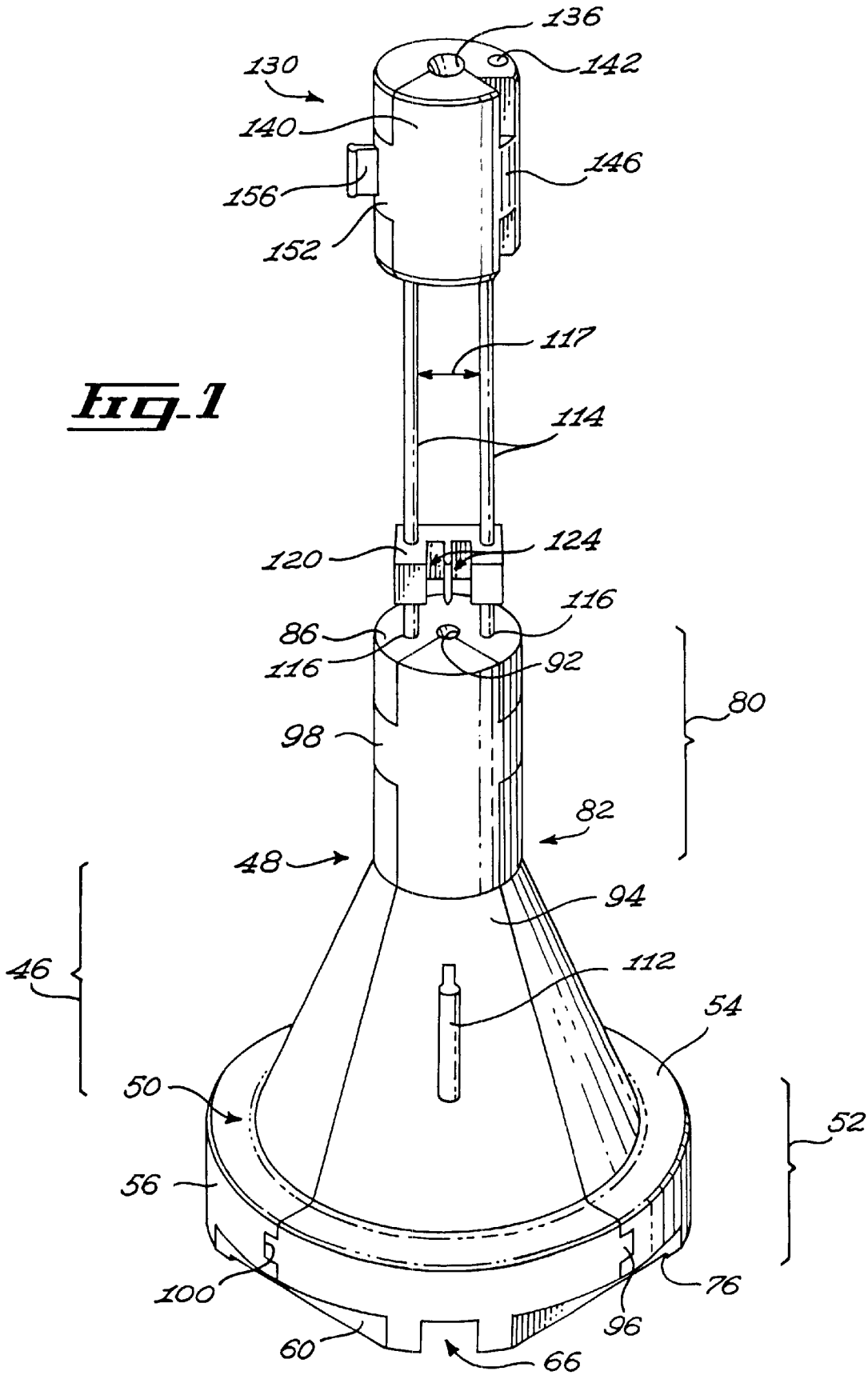
FIG. 1: in a perspective view, illustrates an optical fiber winding tool in accordance with an embodiment of the present invention.
Figure 2:
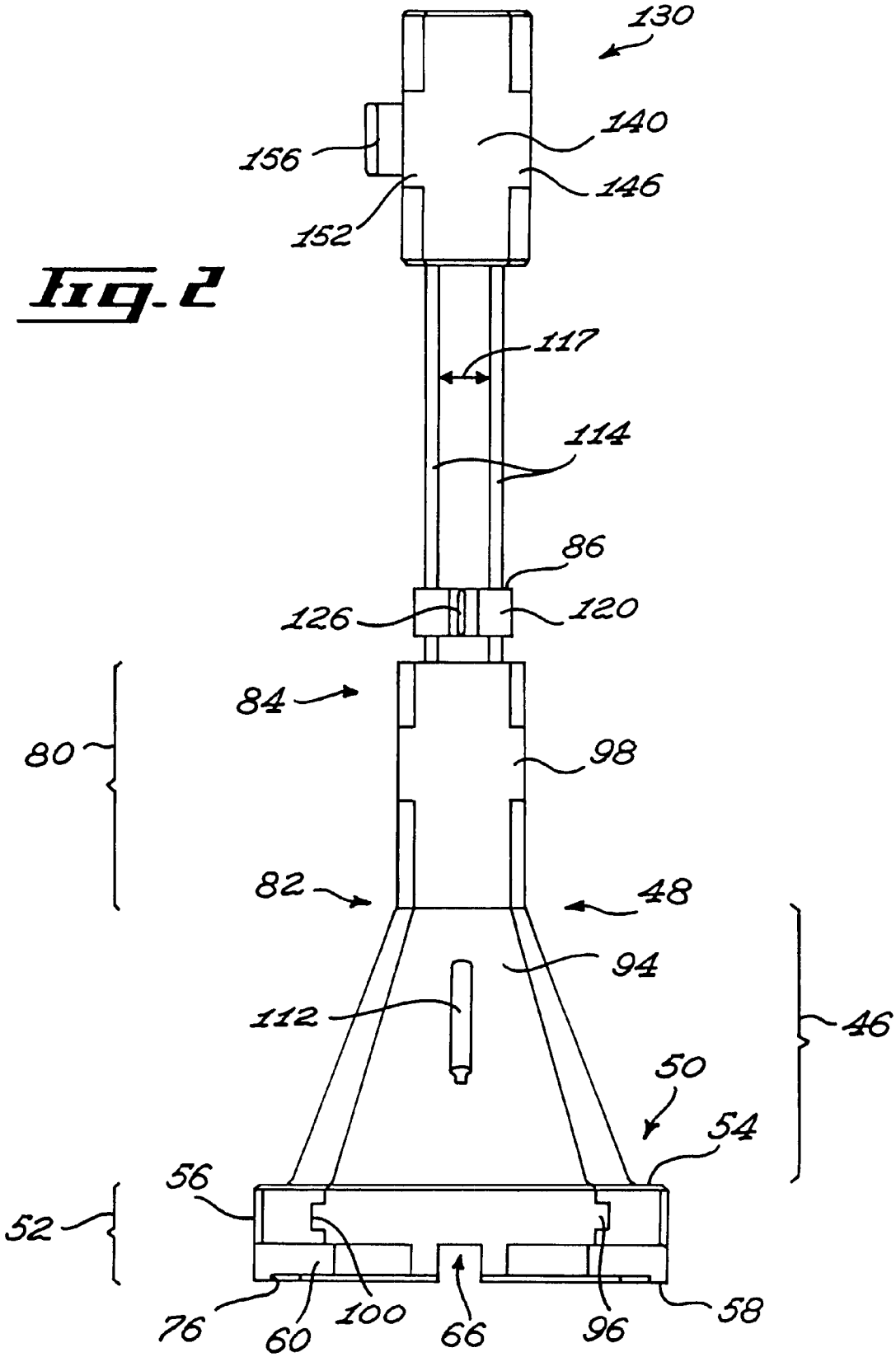
FIG. 2: in a front elevational view, illustrates the optical fiber winding tool shown in FIG. 1.

As shown more specifically in FIGS. 1 and 2, the removable body segment (94) is typically provided with a grasping handle (112) extending from its outer surface. The grasping handle (112) is adapted to facilitate the manipulation of the removable body segment (94) between its opened configuration allowing lateral access to the interior of the guiding recess (22) and its closed configuration wherein the recess peripheral surface forms a substantial continuous surface.

Referring now more specifically to FIG. 3 there is shown that the optical fiber winding tool (10) optionally further includes a hand guiding means attached to the guiding body (18) for guiding the hand (14) of the intended user as the latter drives the strip of optical fiber (12) into the guiding recess (22). The hand guiding means typically includes at least one and preferably two guiding rods (114) mounted in corresponding guiding rod apertures (116) formed in the alignment section attachment surface (86). The guiding rod apertures (116) are preferably positioned adjacent the entrance of the guiding channel (88) and in a diametrically opposed relationship relative to each other. Hence, the guiding rods (114) preferably extend in a predetermined spaced and parallel relationship relative to each other along direction substantially parallel to the guiding channel (88).

The guiding rods (114) define a rod spacing (117) there between. The rod spacing (117) is typically sized so as to allow at least partial insertion of the distal interior pulp of the distal phalanx of opposed fingers (118) such as the thumb and index, or other finger of the hand (14) of the intended user so that a segment of the strip of optical fiber (12) may be grasped between opposed fingers (118) of the hand (14) between the guiding rods (114) that serve as guides for the opposed grasping fingers (118). The guiding rods (114) thus greatly reduce the risk of inadvertently bending the strip of optical fiber (12) in a direction perpendicular to the geometrical plane formed by the alignment of the guiding rods (114) and also reduce the risk of bending the fiber in the geometrical plane formed by the alignment of the guiding rods (114).

Since it is sometimes necessary to simultaneously wind more than one strip of optical fiber (12) into a single coil, the optical fiber winding tool is optionally further provided with a multiple fiber separating means mounted on the guiding body (18) for physically separating and guiding at least two individual optical fiber strips (only one of which is shown throughout the FIGURES) when at least two individual optic fiber strips are inserted simultaneously into the guiding recess (22) through the inlet aperture (32). As illustrated more specifically in FIGS. 1 through 3, the fiber separating means typically includes a separating block (120) mounted on the guiding body (18). The separating block (120) is typically provided with at least one and preferably two block channels (122) extending there through for allowing the separating block (120) to be frictionally mounted on the guiding rods (114). The separating block (120) typically defines at least two separating slots (124) provided with a preferably tapered separating tongue (126) extending there between for individually receiving one of the at least two individual strips of optical fiber (12). The strips of optical fiber (12) being guided and separated adjacent their entrance into the guiding channel (88), hence greatly reducing the risk of having the optical fibers tangled in each other.

The optical fiber winding tool (10) is optionally further provided with a driving means attached to the guiding body (18) for driving the strip of optical fiber (12) into the guiding recess (22) through the fiber inlet aperture (32). As illustrated more specifically in FIGS. 7 and 8, the driving means typically includes a fluid guiding means for guiding a flow designated by arrows (128) of a pressurized fluid in such a manner that the pressurized fluid is in contact with the strip of optical fiber (12) and drives the latter through the fiber inlet aperture (32) and into the guiding recess (22).

Typically, the driving means include a driving head (130) attached to the guiding body (18). Typically, the driving head (130) is attached to the guiding rods (114) opposite the guiding body (18). The driving head (130) has a main fluid channel (132) extending there through. The main fluid channel (132) defines a main channel longitudinal axis (133). The main fluid channel (132) is configured and sized for slideably receiving the strip of optical fiber (12) and allowing through flow (128) of the pressurized fluid there along. The driving head (130) also includes a fluid connecting means for allowing the main fluid channel (132) to be connected to a source of pressurized fluid. Typically, the fluid connecting means includes a coupling component (135) extending radially from the driving head (130) for coupling a source of pressurized fluid such as a source of compressed air, nitrogen or the like. The coupling component (135) is pneumatically coupled to an auxiliary fluid channel (134) in fluid communication with the main fluid channel (132) and typically extending at an angle relative to main fluid channel longitudinal axis (133). Typically, the longitudinal ends of the main fluid channel (132) are provided with outwardly diverging conical tapering sections (136) for both allowing the strip of optical fiber (12) to maintain a minimal bend radius and for creating a Venturi-like effect.

Figure 7:
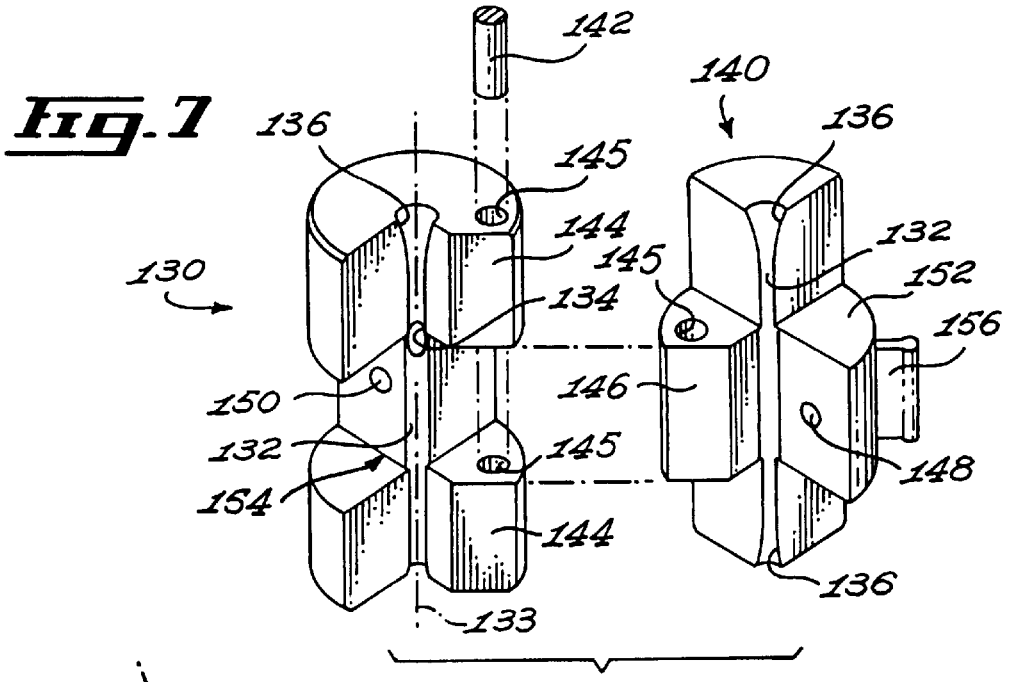
FIG. 7: in a exploded view, illustrates a driving head, part of the optical fiber winding tool in accordance with an embodiment of the present invention.
Figure 8:
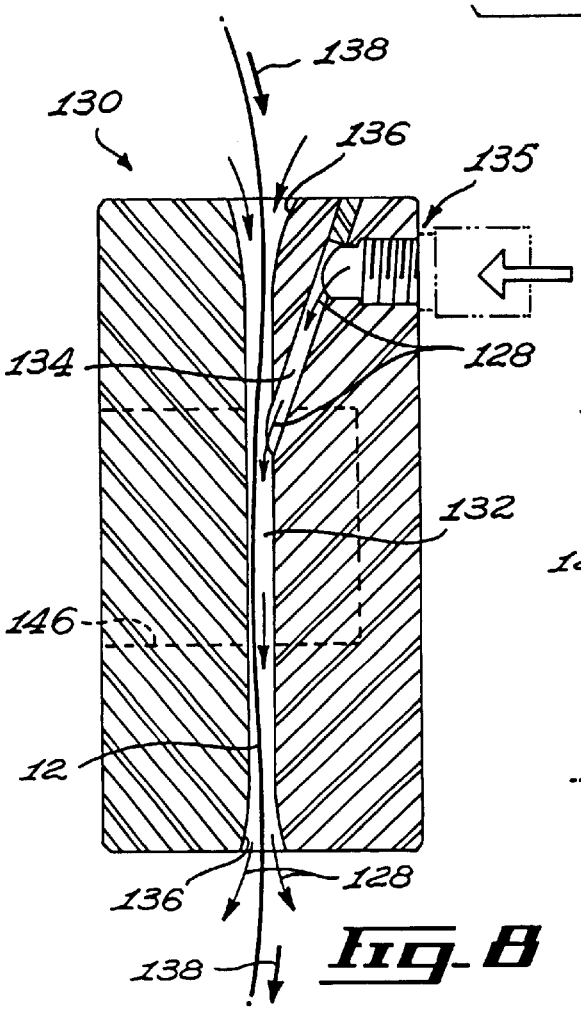
FIG. 8: in a longitudinal cross sectional view, illustrates the internal configuration of a winding head, part of the optical fiber winding tool in accordance with an embodiment of the present invention.

Referring now more specifically to FIGS. 3 and 7, there is shown that the driving head (130) is typically provided with a head panel (140) movable between an opened panel configuration shown in FIG. 3 and a closed panel configuration shown in FIGS. 1 and 2. In the opened panel configuration, the head panel (140) allows lateral access to the main fluid channel (132) from a direction oriented at an angle relative to the main fluid channel longitudinal axis (133). When the head panel (140) is in its closed configuration, the head panel (140) prevents access to the main fluid channel (132) from a direction at an angle relative to the main fluid channel longitudinal axis (133).

Typically, the head panel (140) includes a segment of the driving head (130), pivotally mounted to the remainder of the driving head (130) by a pivotal link such as a pivotal axle (142) inserted into pivotal axle apertures (145) formed in corresponding supporting tongues (144) and (146). The head panel (140) is preferably further provided with a releasable head panel locking means for releasably locking the head panel in its closed configuration. The releasable head panel locking means typically includes a pair of magnet components (148), (150) respectively mounted in a locking tongue (152) extending from the head panel (140) and a locking recess (154) formed in the remainder of the driving head (130). The head panel (140) is also preferably provided with a head panel handle (156) extending therefrom for facilitating handling of the head panel (140) between its opened and closed configurations.

In use, the strip of optical fiber (12) is initially mounted to the optical fiber winding tool (10) through a set of easy and ergonomic steps. The removable body segment (94) is initially removed and the head panel (140) is initially pivoted to its open configuration in order to allow lateral positioning of the intermediate segment of the strip of optical fiber (12) into the guiding channel (88) and into the main fluid channel (132). Optionally, a source of vacuum may be connected to the auxiliary fluid channel (134) so that the a segment of the strip of optical fiber (12) fiber may be temporarily suctioned and retained against the surface of the main fluid channel (132).

The removable body segment (94) is then moved back to its closed configuration wherein the recess peripheral surface (30) forms a generally continuous surface and the head panel (140) is pivoted back to its closed configuration wherein the main fluid channel (132) forms a generally continuous surface. When the optical component (78) is attached to the strip of optical fiber (12), the outlet segment (12') to which it is attached is allowed to extend outwardly on the supporting surface (16) through the fiber outlet slot (76). Initially, both the doors are moved to their opened configuration allowing lateral installation of the fiber into the guiding recess and the guiding channel.

A driving force that may either manual, hydraulic, pneumatic or otherwise is then used to drive the strip of optical fiber (12) into the guiding recess (22). As mentioned previously, when the strip of optical fiber (12) is manually wound, the guiding rods (114) act as guides for the hand (14) of the intended user during the pulling movement indicated by arrow (138) in FIG. 3.

When the strip of optical fiber (12) is pneumatically wound, air or another suitable gas of low moisture content is introduced into the auxiliary fluid channel (134) at a relatively high pressure and flows into the main fluid channel (132) through the Venturi-type conduit formed by the main fluid channel (132). The high-pressure gas frictionally drives the optical fiber (12) towards the inlet aperture (32) as indicated by arrow (138) in FIG. 8. As is well known in the art, a Venturi-like structure exploits the property of a gas flow passing through a constriction. Within the constriction, the axial pressure distribution exhibits a minimum.

The dimension of the Venturi, the values of the supplied pressure and the mass flow of air are typically selected so that the minimum pressure is below atmospheric pressure. In some practical embodiments, the velocity of the gas flow and the constriction flow reach the speed of sound. In other embodiments, the flow throughout the Venturi will remain entirely subsonic. In either case, the Venturi produces a steep rising pressure gradient, accompanied throughout by continued forward flow over a short region within the main fluid channel (132).

The flow of gas, which results from atmospheric pressure at its upstream end and the sub-atmospheric pressure at its downstream end, assists in moving the strip of optical fiber (12) through the main fluid channel (132). On the downstream side of the pressure gradient region, viscous drag on the strip of optical fiber (12) increases considerably due to the high velocity thus assisting in injecting the strip of optical fiber (12) in the guiding recess (22). Depending on the length and diameter of the main fluid channel (132) the conditions within the latter will need to be varied to achieve optimum performance.

The air inlet pressure controls the mass flow of air through the main fluid channel (132) so as to maintain appropriate viscous drag on the strip of optical fiber (12) and appropriate pressure so as to reduce the risk of damaging the strip of optical fiber (12). Optionally, various auxiliary fluid channels (134) could be formed and positioned so as to deliver pressurized fluids at multiple locations around the periphery of the main fluid channel (132) so as to reduce the risk of inducing micro-bending stresses into the strip of optical fiber (12).

The guiding rods (114) are also adapted to act as a spacing means for providing a spacing between the outlet of the main fluid channel (132) and the entrance (92) of the guiding channel (90) so as to prevent a build-up of pressurized gas within the guiding recess (22). The spacing provided by the guiding rods (114) allows the pressurized gas emanating from the outlet of the main fluid channel (132) to diffuse into the environment instead of flowing into the guiding recess (22) through the fiber inlet aperture (32). The guiding rods (114) are thus adapted to act both as a guiding means and as a spacing means respectively when a manual or a pneumatic method of drawing the strip of optical fiber (12) into the guiding recess (22) is used.

Regardless of the method used for drawing the strip of optical fiber (12) into the guiding recess (22), the segment of the optical fiber (12) within the guiding channel (88) remains substantially rectilinear while the segment of the optical fiber (12) within the guiding recess (22) is bent into an arc typically although by no means exclusively having a generally parabolic-like configuration. The arched segment of optical fiber (12) within the guiding recess (22) abuttingly sweeps in circles against the recess peripheral surface (30) and transitions smoothly into convolutes of fibers (12) resting on the supporting surface 16.

Once the strip of optical fiber (12) has been wound into the coil (38), the optical fiber winding tool (10) is lifted from the supporting surface (16) leaving a generally toroidal-shaped coil (38) of optical fiber (12) resting on the supporting surface (16) resiliently urging against the mounting pins (68) or other suitable structures.

What is claimed is:

1. An optical fiber winding tool for winding a strip of optical fiber into a coil, said optical fiber winding tool being mountable on a generally flat supporting surface and allowing manual winding of said strip of optical fiber by the hands of an intended user, said strip of optical fiber defining a strip first longitudinal end, an opposed strip second longitudinal end and a strip intermediate section extending therebetween, said optical fiber winding tool comprising:

a guiding body having a body outer surface and defining a guiding recess, said guiding recess defining a recess peripheral edge delimiting a recess aperture leading into said guiding recess, said recess aperture being in an aperture geometrical plane;

a recess peripheral wall having a recess peripheral surface that extends inwardly into said guiding body from said recess peripheral edge, said recess peripheral surface delimiting the boundary of said guiding recess;

a fiber inlet aperture formed in said guiding body and leading into said guiding recess, said fiber inlet aperture being sized for allowing the slidable insertion of said strip of optical fiber into said guiding recess;

said recess peripheral wall being configured and sized such that when said recess aperture is mounted over said supporting surface and said strip of optical fiber is inserted through said fiber inlet aperture, said strip first longitudinal end contacts said supporting surface and said recess peripheral surface abuttingly guides said strip intermediate section so that further insertion of said strip of optical fiber into said guiding recess causes said strip of optical fiber to wind into a coil against said recess peripheral surface adjacent said supporting surface.

2. An optical fiber winding tool as recited in claim 1 wherein said guiding recess is configured and sized such that said strip of optical fiber maintains a predetermined minimal bend radius as it abuttingly contacts said recess peripheral surface during the winding of said strip of optical fiber into a coil.

3. An optical fiber winding tool as recited in claim 1 wherein said recess peripheral surface has a generally frustro-conical configuration defining a recess apex region.

4. An optical fiber winding tool as recited in claim 3 wherein said fiber inlet aperture is positioned adjacent said recess apex region.

5. An optical fiber winding tool as recited in claim 1 wherein said guiding body also defines an alignment section having a guiding channel that extends from said body outer surface to said fiber inlet aperture, said guiding channel being configured and sized so that said strip of optical fiber maintains a predetermined minimal bend radius as it slides therethrough.

6. An optical fiber winding tool as recited in claim 1 wherein said guiding body includes a removable body segment allowing selective lateral access to the interior of said guiding recess.

7. An optical fiber winding tool as recited in claim 1 further comprising a fiber outlet slot formed in said guiding body for allowing an outlet segment of said optical fiber segment to extend out of said guiding recess in a direction substantially parallel to said aperture geometrical plane and tangential relative to said coil.

8. An optical fiber winding tool as recited in claim 1 further comprising a hand guiding means attached to said guiding body for guiding said hands of said intended user as said intended user drives said strip of optical fiber into said guiding recess.

9. An optical fiber winding tool as recited in claim 8 wherein said hand guiding means includes a guiding rod extending from said guiding body.

10. An optical fiber winding tool as recited in claim 1 further comprising a multiple fiber separating means mounted on said guiding body for physically separating and guiding at least two individual optical fiber strips when said at least two individual optical fiber strips are inserted simultaneously into said guiding recess through said inlet aperture.

11. An optical fiber winding tool as recited in claim 10 wherein said fiber separating means includes a separating block mounted on said guiding body, said separating block having at least two separating slots formed therein for individually receiving one of said at least two individual optical fiber strips.

12. An optical fiber winding tool as recited in claim 1 further comprising a driving means attached to said guiding body for driving said strip of optical fiber into said guiding recess through said fiber inlet aperture.

13. An optical fiber winding tool as recited in claim 12 wherein said driving means includes a fluid guiding means for guiding the flow of a pressurized fluid in such a manner that said pressurized fluid is in contact with said strip of optical fiber and drives said strip of optical fiber through said fiber inlet aperture and into said guiding recess.

14. An optical fiber winding tool as recited in claim 13 wherein said driving means includes a driving head attached to said guiding body, said driving head defining a driving head external surface and having a main fluid channel extending therethrough, said main fluid channel defining a main channel longitudinal axis, said main fluid channel being configured and sized for slidably receiving said strip of optical fiber and for allowing through flow of said pressurized fluid therealong, said driving head also including a fluid connecting means for allowing said main fluid channel to be connected to a source of pressurized fluid.

15. An optical fiber winding tool as recited in claim 14 wherein said driving head is provided with a head panel, said head panel being movable between a panel open configuration and a panel closed configuration, wherein when said head panel is in said panel open configuration said head panel allows access to said main fluid channel from a direction oriented at an angle relative to said main channel longitudinal axis and when said head panel is in said closed configuration said head panel prevents access to said main fluid channel from a direction at an angle relative to said main channel longitudinal axis.

16. An optical fiber winding tool as recited in claim 14 wherein said driving means includes an auxiliary channel extending from said driving head external surface to said main fluid channel at angle relative thereto, said auxiliary channel being in fluid communication with said main fluid channel; said auxiliary channel being provided with a fluid coupling means for coupling said auxiliary channel to a source of pressurized gas.

17. An optical fiber winding tool for winding a strip of optical fiber into a coil, said optical fiber winding tool being mountable over a supporting surface, said optical fiber winding tool comprising:

a generally frustro-conical guiding wall defining
an apex region,
a generally annular base for mounting said guiding wall on said supporting surface and
an inner guiding recess extending from said annular base, said guiding recess defining a recess peripheral surface;

a fiber inlet aperture extending through said guiding wall adjacent said apex region for allowing slidable insertion of said strip of optical fiber into said inner guiding recess towards said annular base;

said recess peripheral surface being configured and sized to abuttingly guide said strip of optical fiber during insertion of the latter through said fiber inlet aperture so that as said strip is slidably inserted into said inner guiding recess, said strip of optical fiber first bends into an arc abutting against said recess peripheral surface and further bends into convolutes of a coil abutting against both said recess peripheral surface and said supporting surface.

18. An optical fiber winding tool as recited in claim 17 further comprising a driving assembly for driving said strip of optical fiber into said guiding recess through said fiber inlet aperture.

19. An optical fiber winding tool as recited in claim 17 wherein said driving means includes a fluid guiding means for guiding the flow of a pressurized fluid in such a manner that said pressurized fluid is in contact with said strip of optical fiber and drives said strip of optical fiber through said fiber inlet aperture and into said guiding recess.

20. An optical fiber winding tool as recited in claim 19 wherein said driving means includes a driving head attached to said guiding body, said driving head defining a driving head external surface and having a main fluid channel extending therethrough, said main fluid channel defining a main channel longitudinal axis, said main fluid channel being configured and sized for slidably receiving said strip of optical fiber and for allowing through flow of said pressurized fluid therealong, said driving head also including a fluid connecting means for allowing said main fluid channel to be connected to a source of pressurized fluid.

* * * * *